US007490584B1

(12) United States Patent
White

(10) Patent No.: US 7,490,584 B1
(45) Date of Patent: Feb. 17, 2009

(54) FUEL ENRICHMENT COLD START/RUN CIRCUIT

(75) Inventor: Brian R. White, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 150 days.

(21) Appl. No.: 11/611,192

(22) Filed: Dec. 15, 2006

(51) Int. Cl.
*F02M 1/16* (2006.01)
*F02M 11/00* (2006.01)

(52) U.S. Cl. ..... 123/179.12; 261/40

(58) Field of Classification Search ..... 123/179.8, 123/179.9, 179.12, 179.13, 179.14, 179.15, 123/494, 575, 576, 578, 579, 581; 261/36.2, 261/38, 40, 41.2, 41.3, DIG. 8; 251/11, 15; 137/494
See application file for complete search history.

(56) References Cited

U.S. PATENT DOCUMENTS 4,346,682 A * 8/1982 Mader ..... 123/179.16
7,051,692 B1 5/2006 Power

* cited by examiner

*Primary Examiner*—Michael Cuff
*Assistant Examiner*—Ka Chun Leung

(74) *Attorney, Agent, or Firm*—Andrus, Sceales, Starke & Sawall, LLP

(57) ABSTRACT

A fuel enrichment cold start/run circuit and method pumps fuel from the fuel pump to an enrichment circuit inlet independently of a carburetor float bowl such that the enrichment circuit is supplied with fuel regardless of the orientation of the float bowl, including angular orientation.

12 Claims, 8 Drawing Sheets

FUEL ENRICHMENT COLD START/RUN CIRCUIT

BACKGROUND AND SUMMARY

The invention relates to a fuel enrichment cold start/run circuit for a carbureted internal combustion engine.

A carbureted internal combustion engine has a fuel pump pumping fuel from a fuel tank to a float bowl of a carburetor which supplies an air fuel mixture to an intake manifold of the engine. A cold start/run circuit supplies enrichment fuel during cold starting and/or running, for example as shown in U.S. Pat. No. 7,051,692, incorporated herein by reference.

The present invention arose during continuing development efforts directed toward fuel enrichment cold start/run circuits, including as noted above. In one desirable embodiment, cold start/run enrichment fuel is provided regardless of orientation of the float bowl of the carburetor, including angular orientation wherein an engine may be tilted upwardly, which orientation may otherwise affect gravity feed of enrichment fuel from a carburetor float bowl to an enrichment fuel reservoir.

BRIEF DESCRIPTION OF THE DRAWINGS

FIG. 1 shows a fuel enriching circuit known in the prior art.

FIG. 2 is a simplified schematic representation of the primary fuel circuit and enrichment fuel circuit of an internal combustion engine.

FIG. 3 is an isometric representation of a carburetor.

FIG. 4 is a section view of the carburetor shown in FIG. 3.

FIG. 5 is a section view of the carburetor shown in FIG. 3.

FIG. 6 is a bottom view of the carburetor shown in FIG. 3.

Present Application

Figure 2:
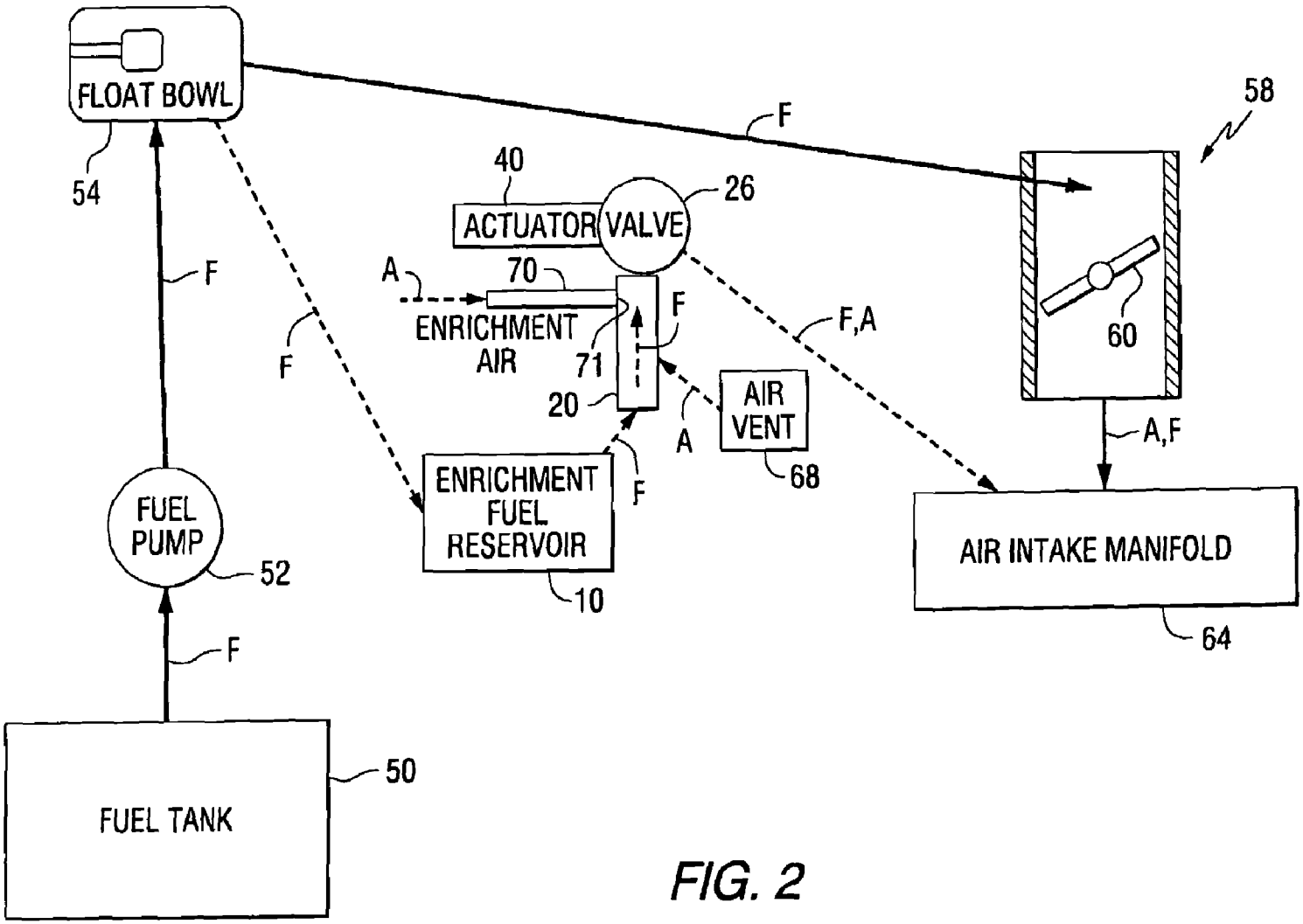
Figure 7:
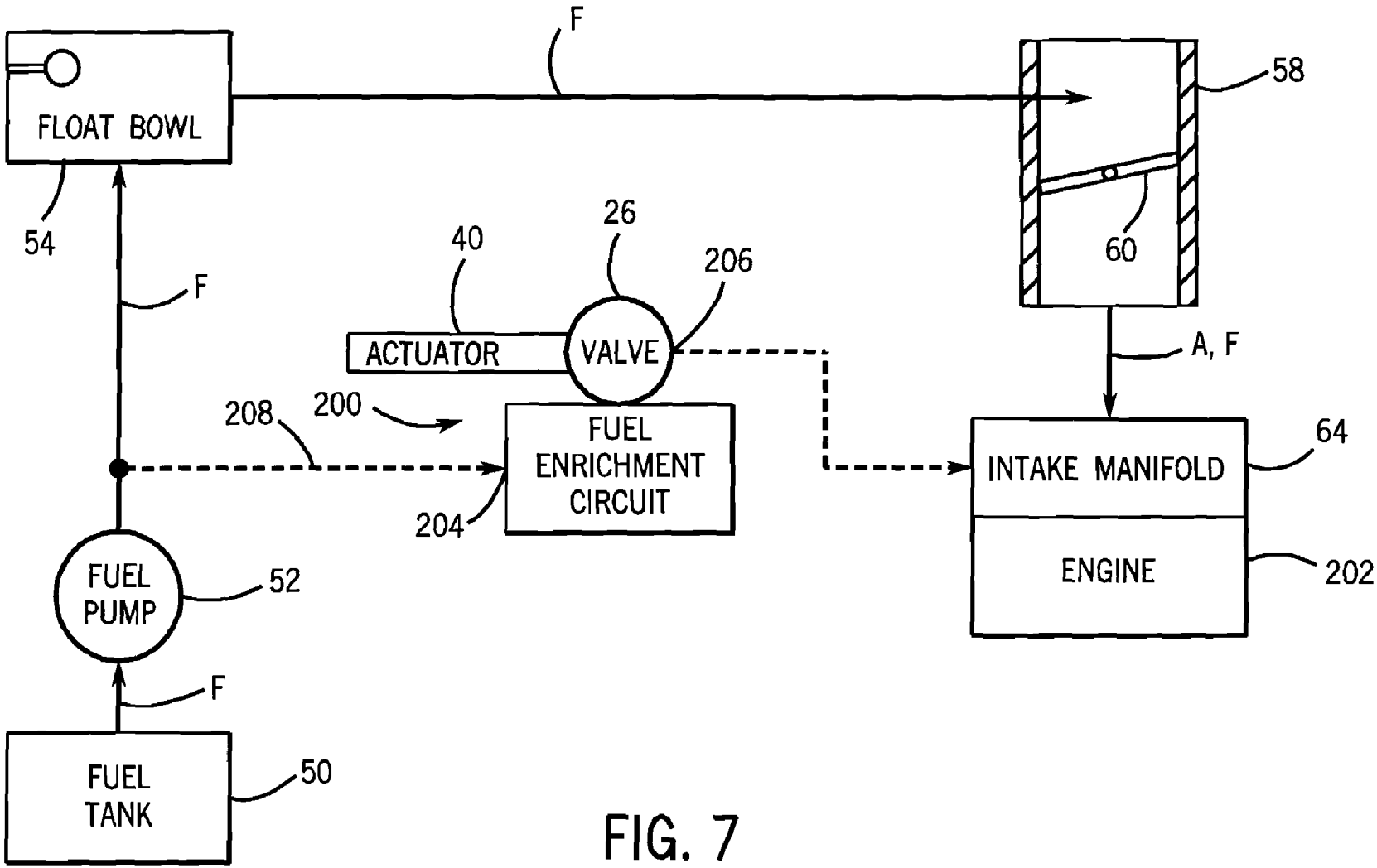

FIG. 7 is like FIG. 2 but illustrates the preferred embodiment of the present invention.

Figure 8:
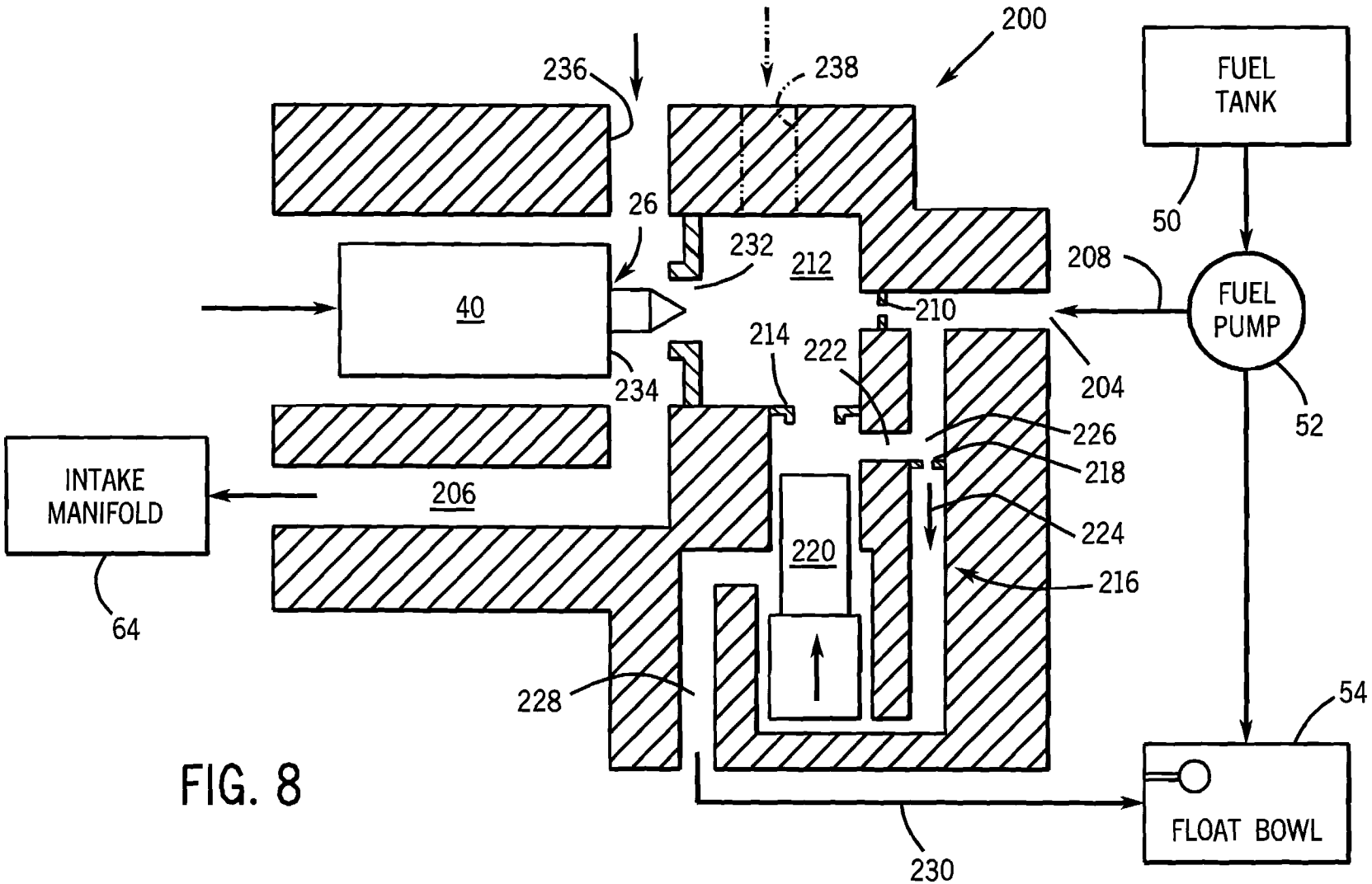

FIG. 8 schematically illustrates the preferred fuel enrichment circuit of FIG. 7.

DETAILED DESCRIPTION

U.S. Pat. No. 7,051,692

The following description of FIGS. 1-6 is taken from the incorporated '692 patent.

Figure 1:
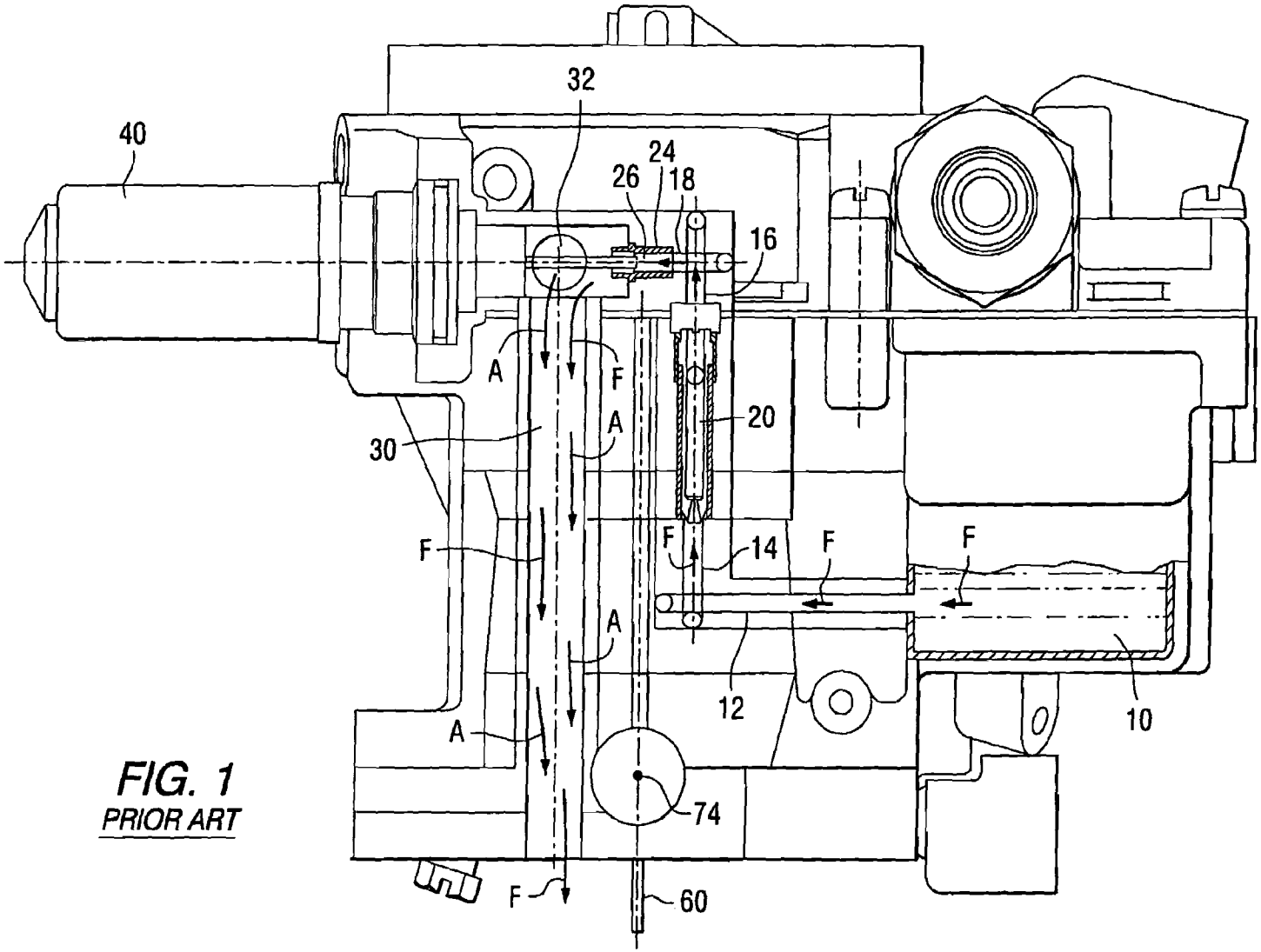
FIG. 1 PRIOR ART
FIGS. 1-6 are taken from the above noted incorporated U.S. Pat. No. 7,051,692.

FIG. 1 shows an apparatus that is generally known to those skilled in the art and is intended for use in starting an internal combustion engine, particularly when the engine is cold. The device shown in FIG. 1 is sometimes referred to by those skilled in the art as an "enriching system" or a "cold engine start fuel system." It contains a fuel reservoir 10 which is configured to provide fuel through a fuel passage that comprises conduits 12, 14, 16 and 18. An emulsion tube 20 is provided as a portion of the fuel passage comprising conduits 14 and 16. When operating to provide fuel during a starting procedure of an internal combustion engine, fuel flows from the reservoir 10 through the emulsion tube 20 and to a region, identified by reference numeral 24, where a valve 26 is movable between first and second positions. When in the first position, the valve 26 permits fluid to flow through conduit 18, through region 24, and into the passage identified by reference numeral 30. The fuel flow, when the valve 26 is in the first position, is identified by arrows F. This fuel flow continues through passage 30 and into the air intake manifold of an engine. The opening identified by reference numeral 32 is an air feed conduit and allows a flow of air to enter the stream of fuel F and flow through the passage 30 toward the air intake manifold. Arrows A represent the flow of air from the air feed conduit 32 into the passage 30.

With continued reference to FIG. 1, when the valve 26 is in the second position it blocks flow through the region identified by reference numeral 24. This inhibits the flow of fuel F from conduit 18 into passage 30. However, it is important to understand that in enriching systems known to those skilled in the art, as represented in FIG. 1, the movement of the valve 26 into its second, or blocking, position does not directly affect the flow of air A through the air feed conduit 32 into the passage 30 or into the air intake manifold.

With continued reference to FIG. 1, the emulsion tube 20 serves the purpose of allowing some air to mix with the fuel F as it passes upwardly through the emulsion tube 20. This results in the flow of a fuel mist upwardly through conduit 16 and, when valve 26 is in its first position, into passage 30 and toward the air intake manifold.

In FIG. 1, a housing 40 contains a valve actuator which moves the valve 26 along a horizontal path between its first and second positions. It is well known to those skilled in the art that a wax element can be used to move the valve 26 toward the right in FIG. 1 when the temperature of the wax element exceeds a predetermined magnitude. The internal operation of the valve actuator within the valve actuator 40 will be described in greater detail below.

As can be seen in FIG. 1, enriching systems known to those skilled in the art provide the air feed conduit 32 at a location downstream from the region 24 where the valve 26 is located. In other words, the air feed conduit 32 is located between the valve 26 and passage 30 which leads to the air intake manifold. As a result, the air feed conduit 32 remains connected in fluid communication with passage 30 and with the air intake manifold regardless of the position of the valve 26.

FIG. 2 is a schematic representation which illustrates the primary fuel supply system of an internal combustion engine in conjunction with a preferred embodiment of the '692 patent. For purposes of reference, the primary fuel supply system is illustrated with solid line arrows while the enriching system is illustrated with dashed line arrows. The fuel flows F and air flows A are identified as such in FIG. 2.

The primary fuel tank of a marine vessel is identified by reference numeral 50. A fuel pump 52 draws fuel from the fuel tank and directs that fuel to a float bowl 54 or similar reservoir-like structure. From the float bowl 54, the fuel is directed to the carburetor 58. A butterfly valve 60 controls the amount of air and fuel flowing through the carburetor 58 toward the air intake manifold 64. The mixture of fuel and air is illustrated in FIG. 2 flowing from the carburetor 58 to the air intake manifold 64 of the engine.

With continued reference to FIG. 2, the fuel enriching system, or cold starting system, provides an enrichment fuel reservoir 10, which was described above in conjunction with FIG. 1, that receives fuel from the float bowl 54. It should be noted that a quantity of fuel typically remains within the enrichment fuel reservoir 10 when the engine is turned off. This provides a quantity of fuel that can later be used immediately upon the subsequent starting of the engine. The fuel contained in the enrichment fuel reservoir 10 is drawn toward the air intake manifold by the differential pressure created as a result of the reciprocal motion of the pistons of the engine in conjunction with the timely opening of the intake valves.

In FIG. 2, the fuel F is shown flowing from the enrichment fuel reservoir 10 into the bottom portion of the emulsion tube 20 where it mixes with air from the air vent 68. The valve 26 and its actuator 40 are shown downstream of the emulsion tube 20. The air feed conduit 70, which performs a similar function to the air feed conduit 32 described above, provides a flow of air through the air feed opening 71 which is located downstream of the emulsion tube 20. Although the air feed opening 71 is shown in FIG. 2 at the upper end of the emulsion tube 20, it should be understood that a physical embodiment of the '692 patent would most likely place this opening 71 at a location between the emulsion tube 20 and the valve seat of the valve 26. In FIG. 2, this relationship is schematically represented and does not represent an actual physical structure.

If the valve 26 is in its first position, fuel is allowed to flow to the air intake manifold 64 along with a mixture of air received from both the air feed conduit 70 and the air vent 68 of the emulsion tube 20. This flow of fuel and air from the valve 26 to the air intake manifold 64 bypasses the butterfly valve 60.

With continued reference to FIG. 2, it should be noted that closure of the valve 26, or placement of the valve 26 in its second position, blocks the flow of air A through the air feed conduit 70, the air vent 68, and the air connection opening 71 and thus does not permit this additional air to flow to the air intake manifold 64 when the valve 26 is in its second position. This blockage of air through the air feed conduit 70 can be important because it facilitates the calibration of the engine and allows greater accuracy. The additional flow of air through the air feed conduit 32 shown in FIG. 1 can be unpredictable and can provide a quantity of air to the air intake manifold, during normal operation of the engine, which adds to the quantity of air flowing through the throttle body mechanism of the carburetor 58. In a preferred embodiment of the '692 patent, the location of the air feed conduit 70 upstream from the valve 26 blocks that unpredictable flow of air to the air intake manifold 64 when the valve 26 is closed, or in its second position.

Figure 3:
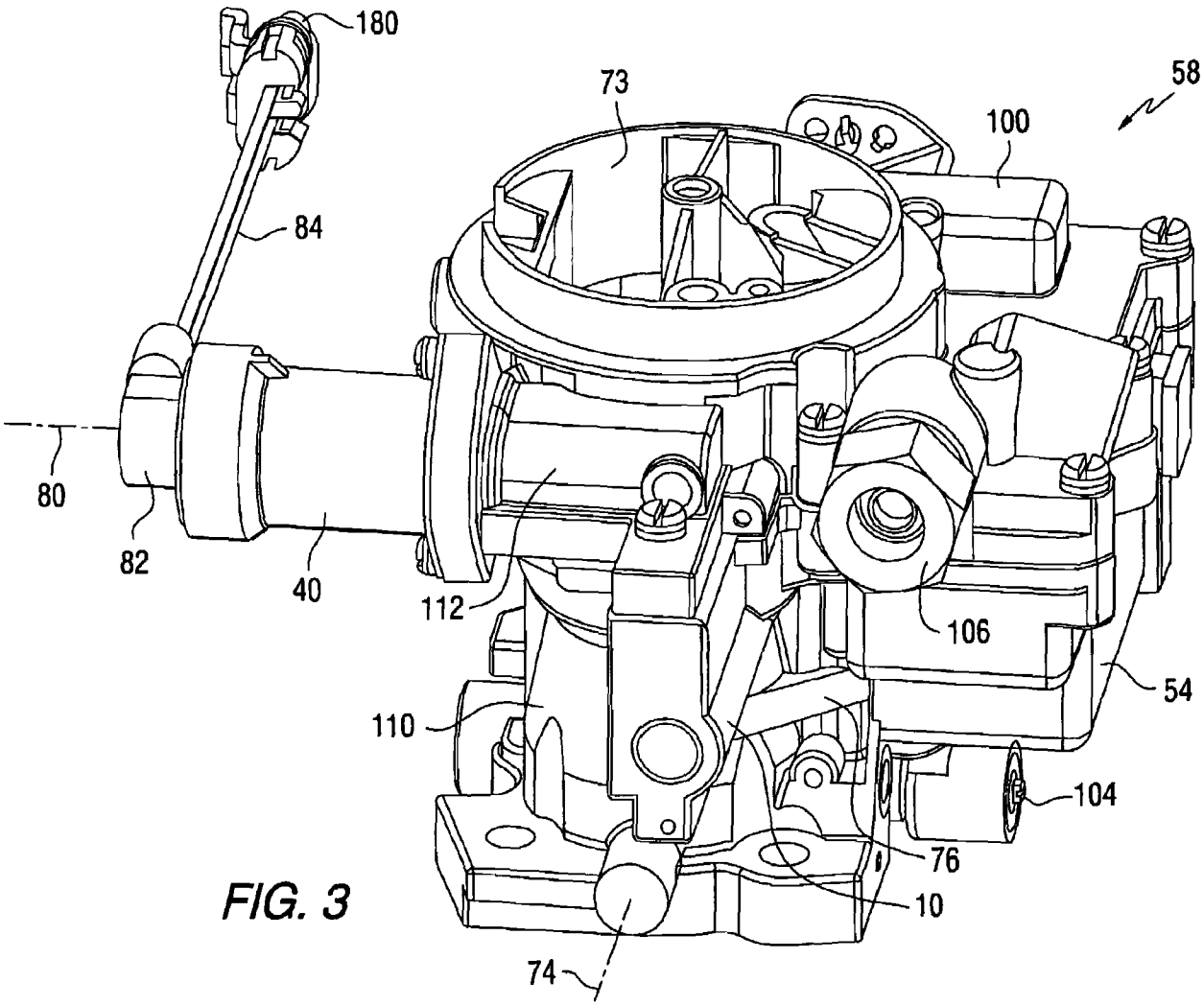

FIG. 3 is an isometric representation of a carburetor 58 made in accordance with a preferred embodiment of the '692 patent. The carburetor 58 comprises a primary air flow passage, or bore 73, through which air flows downwardly past a butterfly valve which is supported for rotation about axis 74. The butterfly valve 60, which is described above in conjunction with FIGS. 1 and 2, is not visible in FIG. 3. Fuel is conducted, through an enrichment fuel passage 76, from the float bowl 54 to the enrichment fuel reservoir 10. The actuator housing 40 contains the wax element described above, in conjunction with FIGS. 1 and 2, and a plunger mechanism that moves the valve 26 along the generally horizontal axis 80 between its first and second positions. An electric heater 82 is provided to change the temperature of the wax element within the valve actuator 40 in order to allow better control of the enriching system. The operation of the heater 82 will be described in greater detail below. The wires 84 provide electricity to operate the heater 82 under control of a temperature sensing switch, which can be connected in electrical communication to the heater by the connector 180 or, in certain embodiments, to a microprocessor such as an engine control module.

An accelerator pump 100, an idle mixture screw 104, and a fuel inlet fitting 106 can also be seen in FIG. 3. The venturi bore 110 is identified in FIG. 3. The valve 26, which is described above in conjunction with FIG. 2, is located within the structure identified by reference numeral 112.

Figure 4:
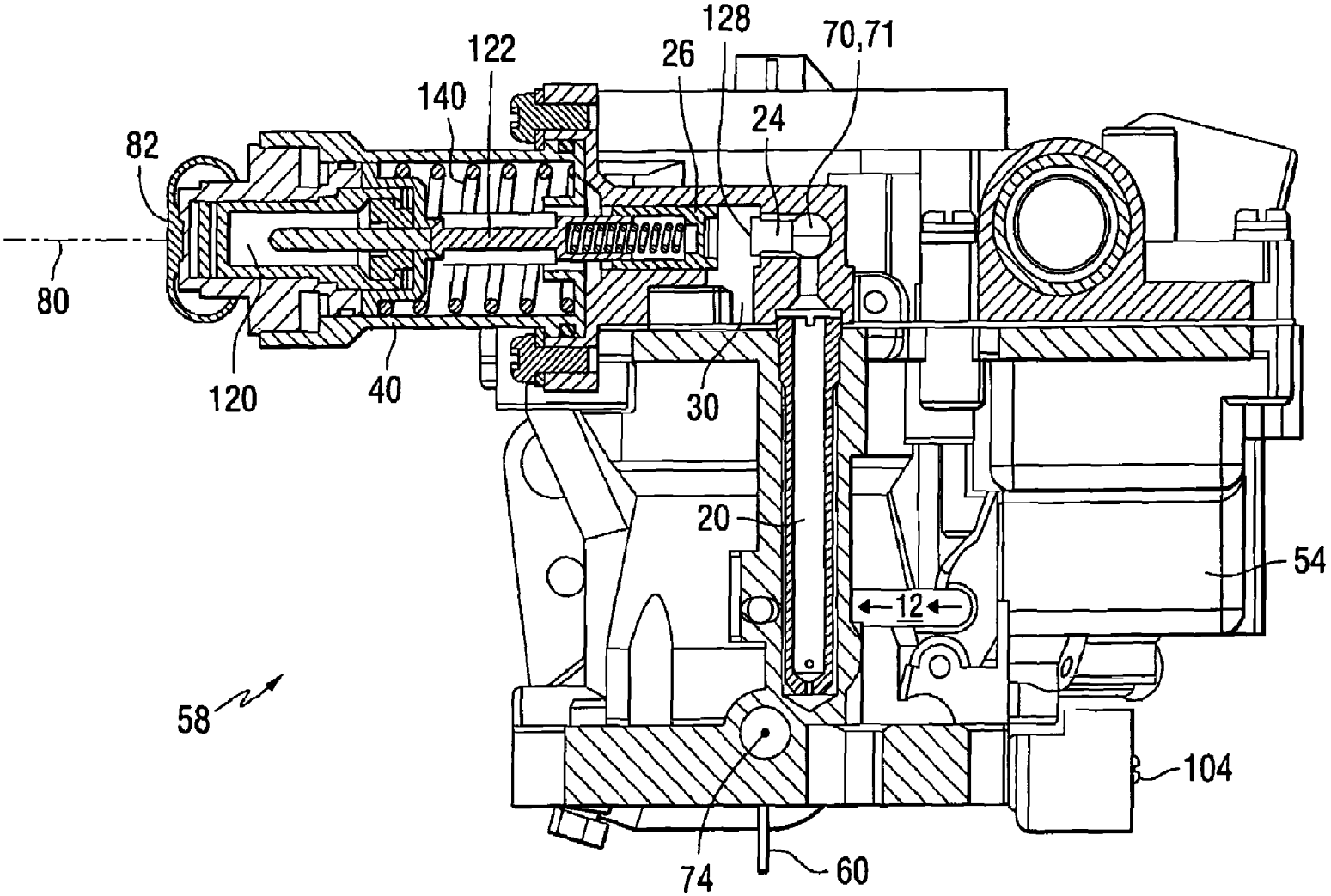

FIG. 4 is a section view of the carburetor 58. Within the valve actuator 40, the wax element 120 is configured to expand in response to increasing temperature. Expansion of the wax pellet 120 forces the plunger 122 of the valve actuator toward the right in FIG. 4. This moves the valve 26 from its first position, illustrated in FIG. 4, to a second position in which the valve moves into contact with a valve seat 128 to block flow through region 24. A spring 140 urges the plunger 122 of the actuator toward the left in FIG. 4 to maintain the valve 26 in its first, or opened position. Expansion of the wax element 120 overcomes this force of the spring 140 to move the valve 26 toward the right and toward its closed, or second position. Therefore, the temperature of the wax element 120 governs the position of the valve 26. As described above, when the valve 26 is in its first position, as illustrated in FIG. 4, fuel can flow through the enrichment fuel passage 12 and upwardly through the emulsion tube 20 and region 24. It then flows through the valve seat 128 and into the passage 30 that leads downwardly into the air intake manifold 64 as described above in conjunction with FIG. 2. Air is mixed with this fuel because of the air feed conduit 70 which directs a flow of air into fluid communication with the fuel flowing upwardly through the emulsion tube 20. This fuel/air mixture then flows through the opening of the valve seat 128 and downwardly through passage 30 toward the air intake manifold. When the valve 26 moves toward its second position, with the valve 26 in contact with the valve seat 128, fuel flow through the emulsion tube 20 and region 24 is blocked. Because of the location of the air feed conduit 70 in relation to the valve seat 128, air is also blocked from flowing through the air feed conduit 70. It can be seen, by comparing FIGS. 1 and 4, that the position of the air feed conduit 70 in a preferred embodiment of the '692 patent illustrated in FIG. 4 is upstream from the valve 26 and its valve seat 128. In other words, the air feed conduit 70 is between the valve 26 and the enrichment fuel reservoir 10 (not illustrated in FIG. 4). With reference to FIGS. 2, 3 and 4, it can be appreciated that the air feed conduit 70 is located between the valve 26 and the enrichment fuel reservoir 10, the enrichment fuel passage 12, and the emulsion tube 20. As a result, movement of the valve 26 into its second positions blocks the flow of fluid through the emulsion tube 20 and also through the air feed conduit 70. This prevents any flow to the air feed conduit 70 toward the air intake manifold when the valve 26 is closed, or in its second position.

The purpose of the wax element 120 is to use the valve 26 to activate or deactivate the enrichment circuit. When both the engine and the wax element 120 are cold, it is desirable to have the valve 26 in an open position to allow free flow of fuel and air from the enrichment fuel reservoir 10 and the emulsion tube 20 into the air intake manifold 64. When both the engine and the wax element 120 are at operating temperature, it is desirable to close the valve 26 and prevent flow of fuel through the enrichment system. Because of the location of the air feed conduit 70 of the '692 patent, this closure of the valve 26 when the engine is at operating temperature also prevents the flow of air through the air feed conduit 70 toward the air intake manifold 64. A certain condition can arise in which the temperature of the wax element 120 does not reliably conform to the temperature of the engine. For example, if the engine is operated for a short period of time which is sufficient to raise its temperature above a magnitude that could be considered a "cold start" temperature, it is not desirable to have the enrichment system operative. However, during that brief operation of the engine, which raised its temperature above this magnitude, followed by a brief period of inactivity, the wax element 120 may have sufficient opportunity and elapsed time to cool down to a temperature that allows the spring 140 to open the valve 26. This would place the valve 26 in its first position even though the engine itself is at a sufficiently high temperature to preclude the necessity of using the enrichment circuit. In other words, the physical location of the wax element 120 may allow it to cool down to a temperature which is less than the actual temperature of the engine. If the operator initiates an engine start procedure at this time, the wax element 120 would normally allow operation of the enrichment circuit because of the open position of the valve 26. The heater 82 allows this potentially disadvantageous circumstance to be avoided.

A temperature switch connector 180 (shown in FIG. 3) can be connected to a sensor which can be placed in thermal communication with the engine. If the temperature switch connector 180 comprises a normally open switch element, which closes when the engine temperature exceeds a preselected threshold, that temperature switch can provide electricity to the heater 82 which heats the wax element 120 whenever the engine is above that preselected temperature. In other words, the heater 82 causes the temperature experienced by the wax element 120 to simulate the actual temperature of the engine. When the engine is allowed to cool to a temperature below that which would require use of the enrichment circuit, the switch opens and allows the wax element 120 to cool and move the valve 26 toward its first position which is toward the left in FIG. 4. Upon the subsequent activation of the ignition system of the engine, the enrichment system is operative and will assist the activation of the engine with fuel passing through the emulsion tube 20.

Figure 5:
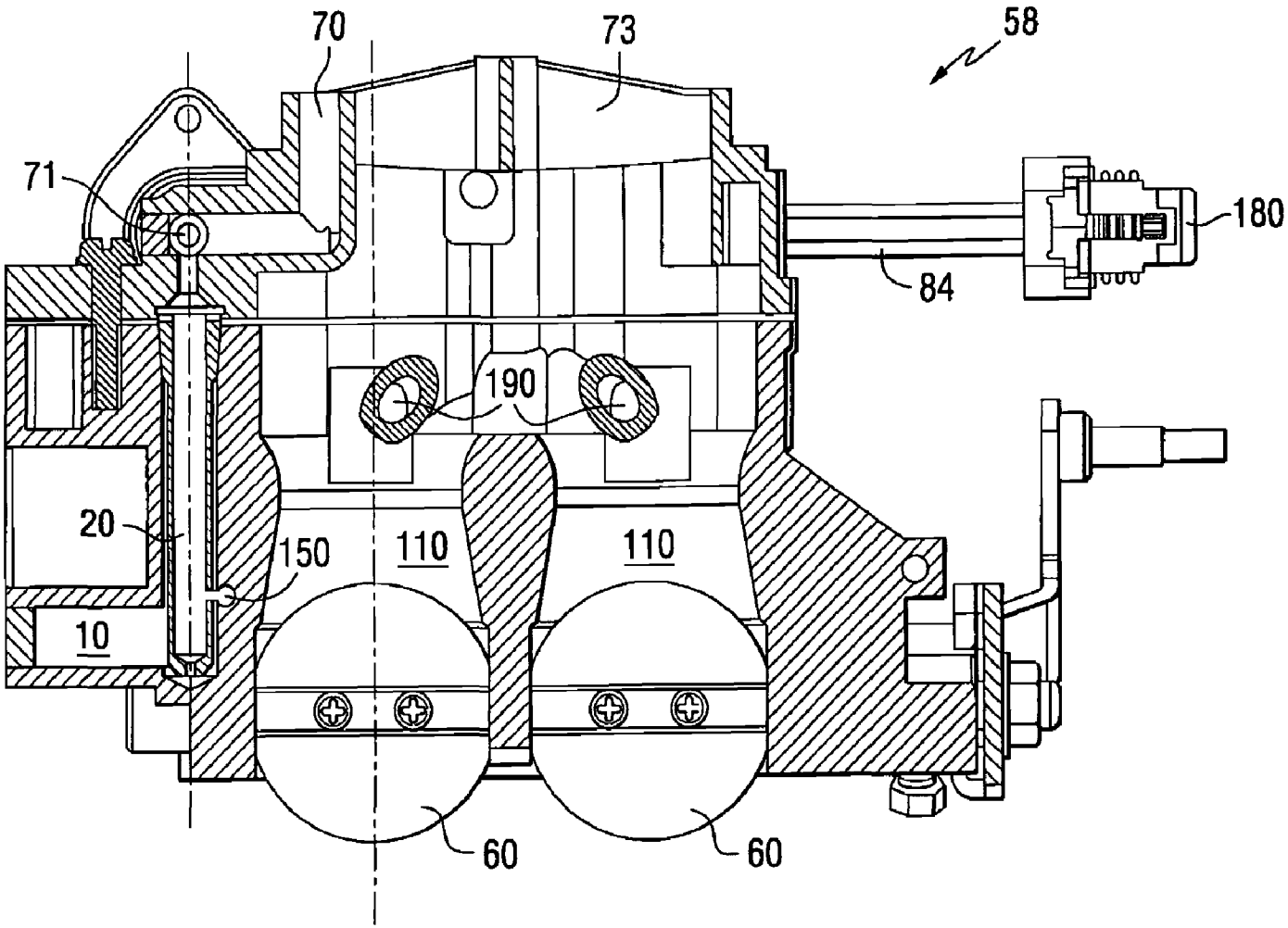

FIG. 5 is a section view of the carburetor 58 which is intended to show the relative locations of certain elements of the '692 patent. On the left side of FIG. 5, the enrichment fuel reservoir 10 is shown near the bottom portion of the emulsion tube 20. An opening 150 serves the purpose of the air vent 68 in FIG. 2 and is also illustrated proximate the bottom portion of the emulsion tube 20. The opening 150 allows a quantity of air to be mixed with fuel as it flows upwardly through the emulsion tube 20 before it reaches the air connection opening 71 downstream from the emulsion tube 20 and upstream from air feed conduit 70 which leads to the air intake manifold. Also shown in FIG. 5 are two butterfly valves 60 located below the venturi bores 110. The primary fuel system directs a fuel/air mixture through the openings identified by reference numeral 190.

Figure 6:
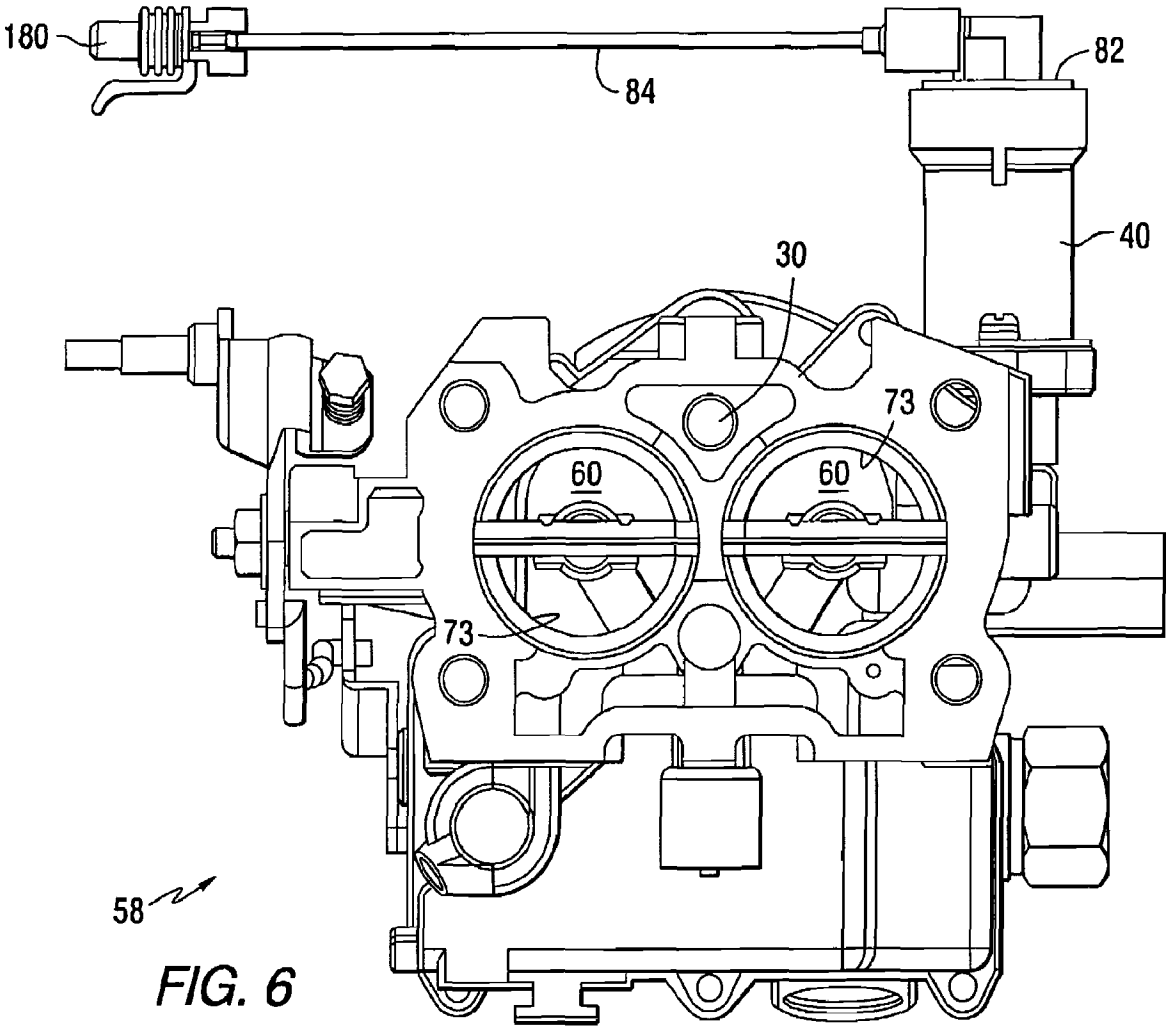

FIG. 6 is another view of the carburetor 58. The two butterfly valves 60 are shown. The passage 30 illustrates the position, relative to the two primary air passages 73 of the carburetor 58, where the enriching air fuel mixture passes through the body of the carburetor toward the air intake manifold. This opening is identified by reference numeral 30 and is described in conjunction with FIG. 1 (with reference to the prior art) and 4. FIG. 6 is a bottom view of the carburetor 58.

As described above, an apparatus for facilitating the starting of an internal combustion engine, made in accordance with a preferred embodiment of the '692 patent, comprises a first fuel reservoir 10 and a first conduit connected in fluid communication with the first fuel reservoir 10. The first fuel conduit comprises the passages between the first fuel reservoir 10 and a valve 26. An air feed conduit 70 is connected in fluid communication with the first conduit. A second conduit, such as the passage identified by reference numeral 30, is connected in fluid communication with an air intake manifold 64 of the internal combustion engine. The valve 26 is connected in flow control relation between the first conduit and the second conduit 30. The valve 26 is movable between a first position and a second position. The first position permits fluid flow from the first conduit to the second conduit 30. The second position inhibits fluid flow from the first conduit to the second conduit 30. The air feed conduit 70 is disposed in fluid communication between the fuel reservoir 10 and the valve 26. The second conduit 30 is disposed in fluid communication between the valve 26 and the intake manifold 64 of the internal combustion engine. A second fuel reservoir 54, or float bowl reservoir, can be connected in fluid communication with the first conduit. The second fuel reservoir can be a float controlled fuel bowl of the internal combustion engine. An air bleed conduit 150 can be connected in fluid communication with the first conduit and, more particularly, with the emulsion tube 20. The first conduit comprises the emulsion tube portion 20 within which liquid fuel-F from the first fuel reservoir 10 is mixed with air from the air bleed conduit 150. A valve actuator is configured to move the valve 26 in response to the temperature of the valve actuator. The valve actuator moves the valve 26 into the second position when the temperature of the valve actuator, or wax element 120, is greater than a first preselected magnitude. The valve actuator moves the valve into the first position, under the influence of spring 140, when the temperature of the valve actuator is less than a second preselected magnitude. The valve actuator contains the thermally sensitive wax element 120.

In a preferred embodiment of the '692 patent, it further comprises a valve actuator heater 82. A thermally responsive switch is provided for causing the valve actuator heater 82 to be energized in response to the internal combustion engine being at a temperature which is higher than a first preselected temperature threshold. The thermally responsive switch is configured to cause the valve actuator heater 82 to be de-energized in response to the internal combustion engine being at a temperature which is lower than a second preselected temperature threshold.

With continued reference to FIGS. 2 6, it can be seen that the apparatus for facilitating the starting of an internal combustion engine made in accordance with a particularly preferred embodiment of the '692 patent, provides a fuel reservoir 10, an air intake manifold 64 of an internal combustion engine, and a fuel supply conduit which is connected in fluid communication between the fuel reservoir 10 and the air intake manifold 64. In this terminology, the fuel supply conduit comprises the passages identified by reference numerals 12, 14, 16, 18, 20, and 30 illustrated in FIG. 1. This fuel supply conduit is configured to conduct a stream of fuel from the fuel reservoir 10 to the air intake manifold 64. An air supply conduit 70 is connected to this fuel supply conduit. The air supply conduit 70 is configured to conduct a stream of air into fluid communication with the stream of fuel flowing from the fuel reservoir 10. A valve 26 is associated with the fuel supply conduit. The valve 26 is disposable in a first position and a second position. The first position permits fuel to flow through the fuel supply conduit from the fuel reservoir 10 to the air intake manifold 64. The second position of the valve 26 inhibits fuel from flowing through the fuel supply conduit from the fuel reservoir 10 to the air intake manifold 64. The air supply conduit 70 is connected in fluid communication with the fuel supply conduit at a point upstream of the valve 26 and between the valve 26 and the fuel reservoir 10.

A valve actuator 40 is connected in force transmitting relation with the valve 26. The valve actuator 40 is configured to cause the valve 26 to be in the first position when the internal combustion engine is below a first preselected temperature and to be in the second position when the internal combustion engine is above a second preselected temperature. The valve actuator 40 comprises a wax element 120 in a particularly preferred embodiment and a heater 82 is connected in thermal communication with the valve actuator 40 in a preferred embodiment of the '692 patent.

Present Application

FIGS. 7 and 8 illustrate the preferred embodiment of the present invention and use like reference numerals from above where appropriate to facilitate understanding.

Fuel enrichment circuit 200 is provided for carbureted internal combustion engine 202 having fuel pump 52 pumping fuel from fuel tank 50 to float bowl 54 of carburetor 58 which supplies an air fuel mixture A, F to intake manifold 64 of engine 202. The enrichment circuit has an inlet 204 receiving pumped fuel from fuel pump 52, and has an outlet 206 supplying fuel to intake manifold 64 of engine 202. Enrichment valve 26 is provided between inlet 204 and outlet 206 and is actuatable by actuator 40, as above, between an open condition passing fuel from inlet 204 to outlet 206, and a closed condition blocking the passing of fuel from inlet 204 to outlet 206. Enrichment valve 26 is actuated to the closed condition upon a given warmed-up state of the engine, as above, e.g. when the temperature of the noted wax element exceeds a predetermined magnitude.

Inlet 204 receives pumped fuel at fuel line 208 independently of float bowl 54. In the preferred embodiment, inlet 204 receives pumped fuel at 208 from fuel pump 52 without gravity feed from float bowl 54, as in FIG. 2, such that inlet 204 is supplied with fuel regardless of the orientation of float bowl 54, including angular orientation, e.g. when a motor is tilted upwardly. The fuel enrichment circuit 200 is thus provided with fuel regardless of the fuel level in or orientation of carburetor float bowl 54.

Fuel enrichment circuit 200, FIG. 8, includes a first supply jet 210 supplying fuel from inlet 204 to a plenum 212, and a second supply jet 214 supplying fuel from inlet 204 to plenum 212 in parallel with first jet 210. Plenum 212 supplies fuel to outlet 206. Valve 26 is between plenum 212 and outlet 206. A timer 216 closes second jet 214 after a timing interval following a cold start, such that upon initial cold start, enrichment fuel flows through both the first supply jet 210 and the second supply jet 214 into plenum 212, and after the timing interval, enrichment fuel flows through the first supply jet 210 but not the second supply jet 214 into plenum 212.

In the preferred embodiment, timer 216 is provided by a timer jet 218 supplying fuel from inlet 204 to a timer valve 220 having an open condition, as shown in FIG. 8, permitting fuel flow through the second supply jet 214, and a closed condition, moved upwardly in FIG. 8, blocking fuel flow through second supply jet 214. The circuit includes first and second passages 222 and 224 leading from a junction 226 receiving fuel from inlet 204. First passage 222 supplies fuel from junction 226 to second supply jet 214. Second passage 224 supplies fuel from junction 226 through timer jet 218 to timer valve 220. Second passage 224 has a drain outlet 228 downstream of timer jet 218 and draining fuel through drain fuel line 230 to float bowl 54. In the preferred embodiment, timer valve 220 is a fuel pressure actuated piston movable between first and second positions respectively opening and closing second supply jet 214, namely between a downward open position and an upward closed position as viewed in FIG. 8. Timer jet 218 has a cross-sectional flow area selected to provide the noted timing interval, namely the smaller the cross-sectional flow area the longer the timing interval and the greater the amount of enrichment fuel supplied through second supply jet 214, i.e. the longer the time required for pressure to build up and drive piston 220 upwardly to its closed position.

The enrichment valve preferably includes a third supply jet 232 supplying fuel from plenum 212 to outlet 206, and a valve member 234 movable between first and second positions respectively opening and closing the third supply jet 232, namely between a leftward open position and a rightward closed position as viewed in FIG. 8. The circuit includes an air inlet 236 supplying combustion air to outlet 206. In one embodiment, air inlet 236 is downstream of third supply jet 232. In another embodiment, as shown in dashed line, air inlet 238 is upstream of third supply jet 232 and downstream of each of the first and second supply jets 210 and 214.

In the preferred embodiment, all four jets are utilized, namely first supply jet 210, second supply jet 214, third supply jet 232, and timer jet 218. Drain outlet 228 is preferred to accommodate fuel leakage around piston 220 and return same to float bowl 54. The present system also provides a desirable method for fuel enrichment during cold start/run, including pumping fuel from fuel pump 52 to fuel enrichment circuit inlet 204 independently of float bowl 54. Fuel is pumped from fuel pump 52 to float bowl 54 and to fuel enrichment circuit 200 at the latter's dedicated fuel line 208 including during the open condition of enrichment valve 40. This method supplies fuel to inlet 204 regardless of the orientation of float bowl 54, including angular orientation, and regardless of the level of fuel in float bowl 54 or orientation thereof.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems, and method steps. It is to be expected that various equivalents, alternatives, and modifications are possible within the scope of the appended claims.

What is claimed is:

1. A fuel enrichment cold start/run circuit for a carbureted internal combustion engine having a fuel pump pumping fuel from a fuel tank to a float bowl of a carburetor which supplies an air fuel mixture to an intake manifold of said engine, said circuit comprising an inlet receiving pumped fuel from said fuel pump, an outlet supplying fuel to said intake manifold of said engine, and an enrichment valve between said inlet and said outlet and actuatable between an open condition passing fuel from said inlet to said outlet, and a closed condition blocking the passing of fuel from said inlet to said outlet, said enrichment valve being actuated to said closed condition upon a given warmed-up state of said engine, wherein said circuit comprises a first supply jet supplying fuel from said inlet to a plenum, a second supply jet supplying fuel from said inlet to said plenum in parallel with said first jet, said plenum supplying fuel to said outlet, said valve being between said plenum and said outlet, a timer closing said second jet after a timing interval following a cold start, such that upon initial cold start, fuel flows through both said first supply jet and said second supply jet into said plenum, and after said timing interval, fuel flows through said first supply jet but not said second supply jet into said plenum.

2. The fuel enrichment cold start/run circuit according to claim 1 wherein said timer comprises a timer jet supplying fuel from said inlet to a timer valve having an open condition permitting fuel flow through said second supply jet, and a closed condition blocking fuel flow through said second supply jet.

3. The fuel enrichment cold start/run circuit according to claim 2 wherein said circuit comprises first and second passages leading from a junction receiving fuel from said inlet, said first passage supplying fuel from said junction to said second supply jet, said second passage supplying fuel from said junction through said timer jet to said timer valve.

4. The fuel enrichment cold start/run circuit according to claim 3 wherein said second passage has a drain outlet downstream of said timer jet and draining fuel to said float bowl.

5. The fuel enrichment cold start/run circuit according to claim 3 wherein said timer valve is a fuel pressure actuated piston movable between first and second positions respectively opening and closing said second supply jet.

6. The fuel enrichment cold start/run circuit according to claim 2 wherein said timer jet has a cross-sectional flow area selected to provide said timing interval, the smaller said cross-sectional flow area the longer said timing interval and the greater the amount of enrichment fuel supplied through said second supply jet.

7. The fuel enrichment cold start/run circuit according to claim 1 wherein said enrichment valve comprises a third supply jet supplying fuel from said plenum to said outlet, and a valve member movable between first and second positions respectively opening and closing said third supply jet.

8. The fuel enrichment cold start/run circuit according to claim 7 wherein said circuit comprises an air inlet supplying combustion air to said outlet.

9. The fuel enrichment cold start/run circuit according to claim 8 wherein said air inlet is downstream of said third supply jet.

10. The fuel enrichment cold start/run circuit according to claim 8 wherein said air inlet is upstream of said third supply jet and downstream of each of said first and second supply jets.

11. A fuel enrichment cold start/run circuit for a carbureted internal combustion engine having a fuel pump pumping fuel from a fuel tank to a float bowl of a carburetor which supplies an air fuel mixture to an intake manifold of said engine, said circuit comprising an inlet receiving pumped fuel from said fuel pump, an outlet supplying fuel to said intake manifold of said engine, four jets comprising first, second, third and fourth jets, said first jet comprising a first supply jet supplying fuel from said inlet to a plenum, said second jet comprising a second supply jet supplying fuel from said inlet to said plenum in parallel with said first jet, said third jet comprising a third supply jet supplying fuel from said plenum to said outlet, said fourth jet comprising a timer jet supplying fuel from said inlet to a timer valve having an open condition permitting fuel flow through said second supply jet, and a closed condition blocking fuel flow through said second supply jet, said timer jet providing a timer closing said second supply jet after a timing interval following a cold start, such that upon initial cold start, fuel flows through both said first and second supply jets into said plenum, and after said timing interval, fuel flows through said first supply jet but not said second supply jet into said plenum, and an enrichment valve comprising a valve member movable between first and second positions respectively opening and closing said third supply jet, said valve member being actuated to said second position upon a given warmed-up state of said engine.

12. A method for providing enrichment fuel for a carbureted internal combustion engine having a fuel pump pumping fuel from a fuel tank to a float bowl of a carburetor which supplies an air fuel mixture to an intake manifold of said engine, comprising providing a fuel enrichment cold start/run circuit having an inlet, an outlet supplying fuel to said intake manifold of said engine, and an enrichment valve between said inlet and said outlet and actuatable between an open condition passing fuel from said inlet to said outlet, and a closed condition blocking the passing of fuel from said inlet to said outlet, said enrichment valve being actuated to said closed condition upon a given warmed-up state of said engine, and comprising supplying pumped fuel from said fuel pump to said inlet including during said open condition of said enrichment valve, supplying fuel from said inlet through a first supply jet to a plenum, supplying said fuel from said inlet through a second supply jet to said plenum in parallel with said first supply jet, supplying fuel from said plenum to said outlet, providing said enrichment valve between said plenum and said outlet, providing a timer and closing said second supply jet after a timing interval following a cold start, said method further comprising, upon initial cold start, supplying fuel through both said first and second supply jets into said plenum, and after said timing interval, supplying fuel through said first supply jet but not said second supply jet into said plenum.

* * * * *